US006320088B1

(12) United States Patent
Matsuno et al.

(10) Patent No.: US 6,320,088 B1
(45) Date of Patent: Nov. 20, 2001

(54) TRACTION DRIVE FLUID

(75) Inventors: Mitsuo Matsuno; Shinichi Shirahama; Tetsuo Okawa, all of Yokohama (JP)

(73) Assignee: Nippon Mitsubishi Oil Corporation, Tokyo (JP)

( * ) Notice: Subject to any disclaimer, the term of this patent is extended or adjusted under 35 U.S.C. 154(b) by 0 days.

(21) Appl. No.: 09/794,924

(22) Filed: Feb. 27, 2001

(30) Foreign Application Priority Data

Mar. 21, 2000 (JP) ..... 12-078153

(51) Int. Cl.[7] ..... C10M 105/02

(52) U.S. Cl. ..... 585/21; 585/22; 585/253; 508/110; 508/591

(58) Field of Search ..... 585/21, 22, 253; 508/110, 591

(56) References Cited

U.S. PATENT DOCUMENTS 4,413,067 * 11/1983 Tsuchiya et al. ..... 523/172
4,419,497 * 12/1983 Tsuchiya et al. ..... 525/338
4,507,516 * 3/1985 Hirooka et al. ..... 585/14
4,675,459 * 6/1987 Yuasa et al. ..... 585/21
5,344,582 * 9/1994 Umemoto et al. ..... 585/21
6,191,330 * 2/2001 Matsuno et al. ..... 585/21

* cited by examiner

*Primary Examiner*—Jacqueline V. Howard
(74) *Attorney, Agent, or Firm*—Akin, Gump, Strauss, Hauer & Feld, L.L.P.

(57) ABSTRACT

Traction drive fluids comprise a saturated polycyclic hydrocarbon compound obtained by hydrogenating a trimeric compound of a cyclopentadiene-based condensed hydrocarbon compound resulting from the Diels-Alder reaction of cyclopentadiene and then isomerizing the resulting compound so as to have a pour point of −10° C. or below. The traction drive fluids can be used not only in driving force transmitting mechanisms but also in hydraulic pressure controlling mechanism and friction properties controlling mechanisms of wet clutches.

7 Claims, No Drawings

TRACTION DRIVE FLUID

BACKGROUND OF THE INVENTION

1. Field of the Invention

This invention relates to traction drive fluids, and more particularly to such traction drive fluids which can be used not only for the driving force transmitting mechanisms but also for hydraulic pressure controlling mechanism and the friction properties controlling mechanisms of the wet clutches of automobiles. The traction drive fluids of the present invention are particularly useful for traction drive type continuously variable transmissions of automobiles.

2. Description of the Prior Art

In the field of industrial machines, traction drive fluids have already been used in traction drive type power transmitting apparatuses which transmit power via oil film. Such traction drive fluids are required to have a high traction coefficient which indicates a power transmission capability.

In recent years, extensive studies and investigations on a traction drive fluid have progressed for its use of the continuously variable transmissions of automobiles. Traction drive fluids to be used for automobiles are expected to be used not only in the power transmitting mechanisms but also in the hydraulic controlling mechanisms and the friction properties controlling mechanisms for the wet clutch.

An automatic transmission fluid (ATF) is known as a lubricating oil used in automobile's transmission hydraulic controlling mechanism and friction properties controlling mechanism of wet clutches. It is a well-known fact that such an ATF is required to have a higher kinematic viscosity at elevated temperatures than a certain level and to be superior in low temperature flowability for performing the role in hydraulic controlling mechanisms. It is also well known that an ATF needs to be blended with additives which have excellent friction properties, particularly anti-shudder properties for fulfilling requirements in performing the role in the friction properties controlling mechanism, particularly the controlling mechanism having in addition thereto slip controlling capabilities.

Therefore, when used in the traction drive type continuous variable transmission of an automobile, a traction drive fluid is required to have driving force transmitting properties which are peculiarly excellent but also properties as a fluid for hydraulic controlling, and friction properties controlling of a wet-type clutch, both of which are required for an ATF.

It is also a well-known fact that a fluid tends to be deteriorated in low-temperature flowability as the traction coefficient increases. Therefore, in the development of a traction drive fluid, it is a major problem how such trade-off relation between traction coefficient and low temperature flowability is deal with.

More specifically, there is a problem that the traction coefficient of a fluid would be reduced if it can achieve the possession of the pour point at −10° C. or below which is required as a traction drive fluid for industrial machines of which usage is limited to indoors or the possession of the low temperature pour point which is required to be also used in the hydraulic controlling mechanisms of traction drive type continuous variable transmissions which have been developed for automobiles.

BRIEF SUMMARY OF THE INVENTION

In view of the current situations, the object of the present invention is to provide a traction drive fluid which is not only superior in power transmitting properties but also can be used in the hydraulic controlling mechanisms of automobiles. Furthermore, the present invention can provide a traction drive fluid which has excellent properties in wet-type clutches which is necessary to be used in automobiles.

Intensive research and efforts made to solve the foregoing problems resulted in the development of a traction drive fluid particularly suitable for use in automobile's traction drive type continuously variable transmission, more specifically a traction drive fluid which can be used not only in hydraulic controlling mechanism and but also the friction properties controlling mechanism of automobile wet clutches.

According to the present invention, there is provided a traction drive fluid which is a saturated polycyclic hydrocarbon compound obtained by hydrogenating a trimeric compound of a cyclopentadiene-based condensed hydrocarbon compound resulting from the Diels-Alder reaction of cyclopentadiene and then isomerizing the resulting hydrogenated compound so as to have a pour point of −10° C. or below.

In addition to the foregoing compound, the traction drive fluid according to the present invention further comprises preferably (A) at least one member selected from the group consisting of a mineral oil and a synthetic oil having a molecular weight of 150 to 800.

Alternatively, the traction drive fluid of the present invention further comprises preferably (B) a viscosity index improver. The viscosity index improver (B) is preferably an ethylene-α-olefin copolymer having a number-average molecular weight of 800 or more and 150,000 or less and hydrides thereof.

Alternatively, the traction drive fluid of the present invention comprises preferably (C) an ashless dispersant and (D) a phosphorus additive.

Further alternatively, the traction drive fluid of the present invention further comprises preferably (E) a friction modifier having at least one alkyl or alkenyl group having 6 to 30 carbon atoms per molecule but having no hydrocarbon group having 31 or more carbon atoms per molecule.

Still further alternatively, the traction drive fluid of the present invention further comprises preferably (E) a metallic detergent having a total base number of 20 to 450 mgKOH/g.

DETAILED DESCRIPTION OF THE INVENTION

The present invention is described in more details below.

A traction drive fluid according to the present invention is a saturated polycyclic hydrocarbon compound obtained by hydrogenating a trimeric compound of a cyclopentadiene-based condensed hydrocarbon compound resulting from the Diels-Alder reaction of cyclopentadiene and then isomerizing the resulting hydrogenated compound so as to have a pour point of −10° C. or below. In the present invention, the saturated polycyclic hydrocarbon compound if it has a pour point of −10° C. or below, can be used suitably. However, those having a pour point of −20° C. or below are preferred, and those having a pour point of −30° C. or below are more preferred. Lower a pour point, the saturated polycyclic hydrocarbon compound is better. The lower limit is the critical point achieved when the compound of the present invention is used.

The saturated polycyclic hydrocarbon compound of the present invention is synthesized through [A] the Diels-Alder reaction, [B] hydrogenation, and [C] isomerization.

[A] the Diels-Alder reaction

The Diels-Alder reaction of cyclopentadiene results in the formation of a dimeric compound thereof and the reaction when further progressed, results in the reaction of the dimer and cyclopentadiene progressed as indicated by the following formula [I] or [II] thereby obtaining a trimeric compound represented by formula (1) or (2) as the main component.

[I]

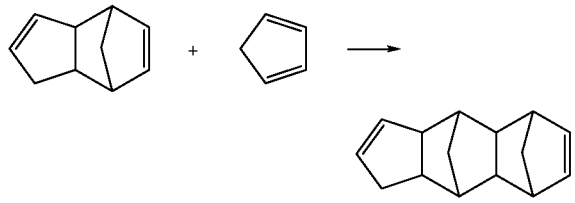

(1)

[II]

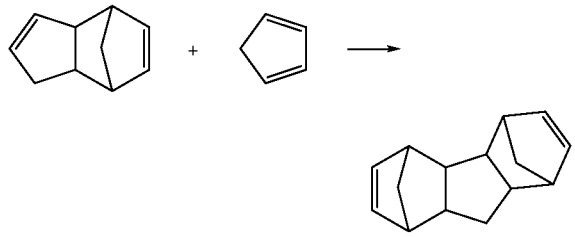

(2)

The Diels-Alder reactions are heat-reaction and thus do not need any catalyst.

Although the cyclopentadiene used in the above-described Diels-Alder reaction may be added in the form of a monomer to the reaction system, dicyclopentadiene which is easily available and produces cyclopentadiene by thermal decomposition may be used as the starting material.

The reaction temperature is arbitrary selected but is usually within the range of 50 to 300° C., preferably 80 to 250° C.

The reaction time is varied depending on the reaction temperature but is usually from 10 minutes to 40 hours, preferably 30 minutes to 30 hours.

In each of the Diels-Alder reactions, if necessary, a polymerization inhibitor such as hydroquinone, p-phenylenediamine, t-butylcatechol may be added so as to suppress the formation of a polymer. These reactions may be conducted in an organic solvent which does not hinder the reaction and may be a lower alcohol such as methanol and ethanol, and a saturated hydrocarbon such as toluene and cyclohexane. Each of the Diels-Alder reactions may be carried out by a batch- or semi-batch-reaction mode or a continuous reaction mode.

The resulting reaction product is subjected to separation and purifying operations such as distillation, crystallization, and separation by a chromatography thereby obtaining a product of formulae (1) and (2) above.

[B] Hydrogenation

A saturated polycyclic hydrocarbon compound represented by formula (3) or (4) below can be obtained by hydrogenating a trimeric compound represented by formula (1) or (2):

(3)

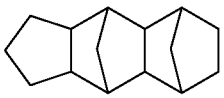

(4)

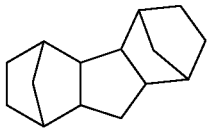

No particular limitation is imposed on the method of hydrogenation. However, it can be conducted under the same conditions where a unsaturated hydrocarbon group is usually hydrogenated.

For example, a double bond is easily hydrogenated using a hydrogenation catalyst which may be a precious metal catalyst such as platinum, palladium, rhodium, and ruthenium, Raney nickel, or nickel diatmite under the conditions of a reaction temperature of 20 to 225° C. and a hydrogen pressure of 0.1 to 20 Mpa.

The hydrogenation can be conducted in the absence of a solvent but if necessary can be conducted in a solvent such as hydrocarbon, an alcohol, an ether, and an ester.

After the hydrogenation, the saturated polycyclic hydrocarbon compound is separated from the solvent, catalyst residue, unreacted products, and by-products by filtration, distillation, or chromato-separation.

[C] Isomerization

Isomerization of the saturated polycyclic hydrocarbon compound can produce the traction drive fluid of the present invention.

The term "isomerization" used herein denotes a reaction which converts part or all of the endo bonds of a compound obtained by the above-described [A] the Diels-Alder reaction and [B] hydrogenation, to exo bonds, the result of which converts the compound to a structural isomer containing more exo bonds. The reaction is exemplified by (i) a reaction converting a compound of formula (5) to that of formula (6), (7) or (8), (ii) a reaction converting a compound of formula (6) to that of formula (8), (iii) a reaction converting a compound of formula (7) to that of formula (8), (iv) a reaction converting a compound of formula (9) to that of formula (10) or (11), and (v) a reaction converting a compound of formula (10) to that of formula (11).

(5)

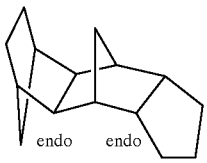

-continued (6)

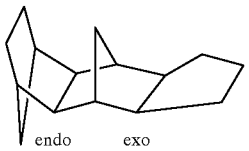

(7)

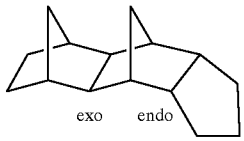

(8)

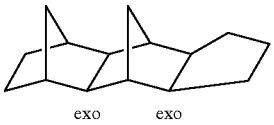

(9)

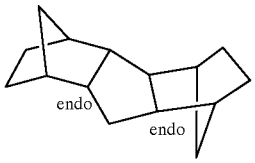

(10)

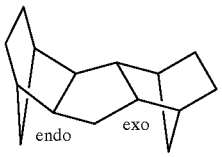

(11)

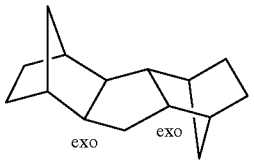

In the case where [A] the Diels-Alder reaction and [B] hydrogenation are conducted in the usual conditions, it is anticipated that the compounds of formulae (5) and (10) which are the saturated polycyclic hydrocarbon compounds separated from the by-product or the like are produced at a ratio of approximately 7 to 3. In such a case, it is anticipated that the saturated polycyclic hydrocarbon compound having a pour point of −10° C. or below according to the present invention can be obtained by isomerizing about 40 percent or more of a mixture of compounds of formulae (5) and (10).

No particular limitation is imposed on the method of isomerization. However, it is conducted using an isomerizing catalyst which may be a Friedel-Crafts catalyst.

This method is conducted using anhydrous aluminum chloride, anhydrous aluminum chloride, anhydrous ferric chloride, anhydrous tin chloride, or tin tetrachloride as a catalyst. The catalyst is particularly preferably anhydrous aluminum chloride but it is not limited thereto. The amount of the catalyst to be used is usually from 1 to 30 percent by mass, and preferably 2 to 10 percent by mass, with respect to the compound to be treated.

A reaction solvent may not be used. However, when it is used, it is preferably a saturated hydrocarbon, an aromatic hydrocarbon, or a halogenated hydrocarbon. Examples of the saturated hydrocarbon are n-hexane, n-heptane, n-octane, cyclohexane, and methylcyclohexane. Examples of the saturated hydrocarbon are benzene, toluene, xylene, ethylbenzene, and nitrobenzene. Examples of the hydrogenated hydrocarbon are methylene chloride, methylene bromide, 1,2-dichloroethane, 1,2-dichloropropane, 1,3-dichloropropane, 1,4-dichlorobutane, and chlorobenzene. The amount of the solvent is from 2 to 5 times more by volume of the substrate.

The reaction temperature is from 0 to 100° C., preferably 15 to 80° C. A temperature of higher than 100° C. would cause the by-production of tar-like material.

Eligible catalysts other than the Friedel-Crafts catalysts are alumina; silica alumina; H-X type zeolites; H-Y type zeolites; zeolites ion-exchanged with the ion of one or more metals selected from the group consisting of alkaline earth metals and rare-earth metals; materials obtained by adding to any one of these catalysts one or more metals selected from the group consisting of iron, cobalt, nickel, platinum, and rhenium; and materials obtained by treating any one of these catalysts with tetrachloride hydrocarbon.

No particular limitation is imposed on the production method of alumina and silica alumina. H-X type zeolites and H-Y type zeolites need not to be special and thus may be commercially available products. Alternatively, these zeolites can be obtained by calcinating an $NH_4$-Y type zeolite. Since H-Y type zeolites are superior in heat resistance, they are are suitable for use at elevated temperatures for a long period of time.

Zeolites ion-exchanged with the ion of one or more metals selected from the group consisting of alkaline earth metals and rare-earth metals are those resulting from the ion exchange of the cation site of X-type or Y-type zeolites, such as $a^+$, $K^+$, and $NH_4^+$ with an alkaline earth metal such as Ca and Mg or a rare-earth metal such as La, Ce, Nd, Yb, and Y. Such zeolites can be obtained by introducing such an alkaline earth metal or rare-earth metal in the form of a metallic salt solution into a zeolite and then drying and calcinating it. In this case, the metal is not supported on a zeolite but necessarily introduced so as to be ion-exchanged with the cation site of a zeolite. No particular limitation is imposed on the ion-exchange rate. However, it is usually within the range of 20 to 100 percent, preferably 45 to 90 percent so as to exhibit the effect.

Among these catalysts, particularly effective catalysts are alumina, silica alumina, H-X type zeolites, H-Y type zeolites, catalysts obtained by adding one or more of metals selected from the group consisting of iron, cobalt, nickel, platinum, and rhenium to an ion-exchanged zeolite, and catalysts obtained by treating the foregoing catalysts with tetrachloride hydrocarbon. The content of platinum and rhenium is within the range of 0.1 to 5 percent in total, of the catalyst weight. The atomic ratio of platinum and rhenium is preferably within the range of 19:1 to 1:3. An ironic metal such as iron, cobalt, and nickel is added in an amount of 0.1 to 10 percent of the catalyst weight. There may be employed a ion-exchange method or an impregnating method.

The catalyst is activated by heating at a temperature of 350 to 600° C. in a stream of an inactivated gas.

The catalyst is used in the form which is suitable for the reaction mode. For example, the catalyst in the form of powder is preferred for a continuous stirring mixing bath, while the catalyst in the form of particulate and pellet is preferred for a fixed-bed type reactor.

The reaction temperature is within the range of 100 to 400° C., while the reaction pressure is atmospheric pressure or a pressure up to 5 MPa.

The reaction mode may be a batch mode, a semi-batch mode or a continuous mode. In the case of using a continuous circulation mode, there may be employed a complete mixing mode using an autoclave or a fixed-bed continuously circulation mode. The reaction time is varied between 5 minutes and 5 hours depending the reaction temperature or reaction mode and can be selected so as to obtain the optimum yields under each of the conditions.

The catalyst can be regenerated when its properties are deteriorated. In the case of using the above-described catalyst, they are regenerated by heating at a temperature of 150 to 500° C. in the presence or absence of hydrogen while supplying an inactivated gas.

Another alternative catalysts are exemplified by those obtained by supporting a sulfate radical and/or a precursor thereof and as the case may be, one or more elements selected from the group consisting of the groups IIb, Vb, VIIb, and VIII of the periodic table or a compound containing the element, on a support comprising a hydroxide or oxide and/or complex hydride or complex oxide of the group III and/or IV metals of the periodic table, followed by calcination and stabilization. Examples of the group III metal are aluminum, gallium, indium, and thallium. Examples of the group IV metal are silicon, germanium, tin, titanium, zirconium, and hafnium. Examples of the group IIb element are zinc, cadmium, mercury. Examples of the group Vb element are vanadium, niobium, and tantalum. Examples of the group VIb element are chrome, molybdenum, and tungsten. Examples of the group VIIb element are manganese and rhenium. Examples of the group VIII element are iron,cobalt,nickel, ruthenium, rhodium, palladium, osmium, iridium, and platinum.

Examples of the sulfate radical and a precursor thereof are sulfuric acid, ammonium sulfate, ammonium sulfite, ammonium bisulfate, and sulfuryl chloride.

A hydroxide or oxide and/or a complex hydride or complex oxide of the group III and/or IV metals of the periodic table may be those precipitated by adding alkali such as ammonia water to a solution of the groups III and/or IV metallic salts or those produced by thermally decomposing the solution.

The group IIb, Vb, VIb, VIIb, or VIII element or a compound containing the element can be supported on the support by impregnation or coprecipitation. Examples of such a compound are halides such as chlorides, bromides, and iodides, chelates such as nitrate, acetate, carbonate, hydrocarbonate, and acetylacetnate, and organic metallic compounds such as zinc diethyl.

The sulfuric radical may be introduced by impregnating a dried hydroxide or oxide and/or a complex hydride or complex oxide of the group III and/or IV metals of the periodic table in a solution containing the sulfuric radical or a precursor thereof, followed by calcination . Alternatively, introduction of the sulfuric radical may be conducted by flowing downwardly a dried hydroxide or oxide and/or a complex hydride or complex oxide of the group III and/or IV metals of the periodic table so as to contact with the foregoing solution, followed by calcination.

No particular limitation is imposed on the order of supporting of the group IIb, Vb, VIb, VIIb, or VIII element or a compound containing the element and introducing a sulfuric radical or a precursor thereof.

The support is treated by impregnating in a 0.01 to 10 moles sulfuric radical concentration solution in an amount of 1 to 10 times of the weight of the support. Alternatively,the support maybe flown downwardly so as to contact with such a solution. After conducting such a treatment, 0.5 percent by mass or more sulfuric radical is contained in the catalyst which has been calcined.

The amount of the group IIb, Vb, VIb, VIIb, or VIII element or a compound containing the element to be supported is 0.01 to 20 parts by weight, preferably 0.1 to 15 parts by weight, based on 100 part by weigh of the support.

Calcination may be conducted after treatment with a sulfuric radical or a precursor thereof and after supporting the group IIb, Vb, VIb, VIIb, or VIII element or a compound containing the element on the support. The catalyst may be prepared by calcinating at a temperature of 400 to 800° C., preferably 450 to 700° C. for 0.5 to 10 hours in the air after both of the treatments.

The catalyst is used in the form which is suitable for the reaction mode. For example, the catalyst in the form of powder is preferred for a continuous stirring mixing bath, while the catalyst in the form of particulate or pellet is preferred for a fixed-bed type reactor.

The reaction temperature is within the range of 100 to 400° C., while the reaction pressure is atmospheric pressure or a pressure up to 5 MPa.

The reaction mode may be a batch mode a semi-batch mode or a continuous mode. In the case of using a continuous circulation mode, there may be employed a complete mixing mode using an autoclave or a fixed-bed continuously circulation mode. The reaction time is varied between 5 minutes and 5 hours depending the reaction temperature or reaction mode and can be selected so as to obtain the optimum yields under each of the conditions.

The above-described saturated polycyclic hydrocarbon compound as it is may be used as the traction drive fluid of the present invention. For the purpose of enhancing traction coefficient, low-temperature flowability and viscosity-temperature properties, the traction drive fluid contains preferably (A) at least one member selected from the group consisting of a mineral oil and a synthetic oil having a molecular weight of 150 to 800, preferably 150 to 500.

Specific examples of mineral oils which may be used include paraffinic- and naphthenic- mineral oils which are produced by subjecting lubricant fractions resulting from the vacuum distillation of residues derived from the atmospheric distillation of crude oil to refining processes such as solvent deasphalting, solvent extraction, hydrocracking, solvent dewaxing, catalytic dewaxing, hydrorefining, sulfuric acid washing, and clay treatment in suitable combination; and n-paraffinic mineral oils. The kinematic viscosity of these mineral oils is not limited but is usually within the range of 1 to 10 $mm^2/s$, preferably 2 to 8 $mm^2/s$.

In the present invention, a synthetic oil has necessarily a molecular weight of 150 to 800, preferably 150 to 500. A molecular weight less than 150 would lead to an increase in evaporation loss, while that greater than 800 would result in a deterioration in flowability at low temperature.

Eligible synthetic oils include poly-α-olefins such as 1-octene oligomer, 1-decene olygomer, and ethylene-propylene oligomer, and hydrides thereof, isoparaffin, alkylbenzene, alkylnaphthalene, diesters such as ditridecyl glutarate, di-2-ethylhexyl adipate, diisodecyl adipate, ditridecyl adipate, and di-2-ethylhexyl sebacate), polyol esters such as trimethylolpropane caprylate, trimethylolpropane pelargonate, pentaerythritol-2-ethyl hexanoate, and pentaerythritol pelargonate, polyoxyalkylene glycol, dialkyldiphenyl ether, and polyphenylether.

Among these synthetic oils, isobutene oligomer, hydrides thereof and synthetic oils represented by formulae (12) through (23) are particularly preferred because the synthetic oils in combination with the aforesaid saturated polycyclic hydrocarbon compound are contributive to the production of a traction drive fluid which has an enhanced traction coefficient and viscosity at elevated temperatures and excellent flowability at low temperatures and thus have totally excellent properties:

(12)

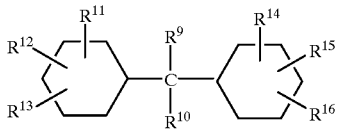

wherein $R^9$, $R^{10}$, $R^{11}$, $R^{12}$, $R^{13}$, $R^{14}$, $R^{15}$, and $R^6$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(13)

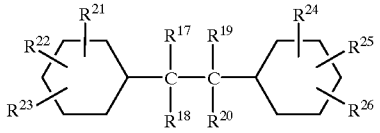

wherein $R^{17}$, $R^{18}$, $R^{19}$, $R^{20}$, $R^{21}$, $R^{22}$, $R^{23}$, $R^{24}$, $R^{25}$, and $R^{26}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(14)

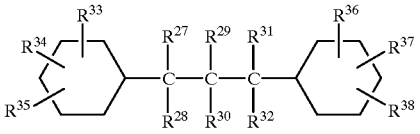

wherein $R^{27}$, $R^{28}$, $R^{29}$, $R^{30}$, $R^{31}$, $R^{32}$, $R^{33}$, $R^{34}$, $R^{35}$, $R^{36}$, $R^{37}$, and $R^{38}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(15)

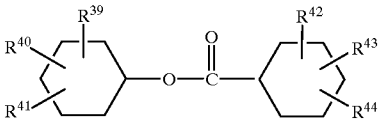

wherein $R^{39}$, $R^{40}$, $R^{41}$, $R^{42}$, $R^{43}$, and $R^{44}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(16)

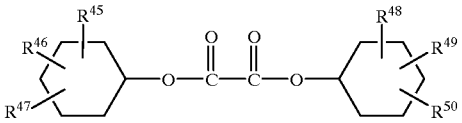

wherein $R^{45}$, $R^{46}$, $R^{47}$, $R^{48}$, $R^{49}$, and $R^{50}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(17)

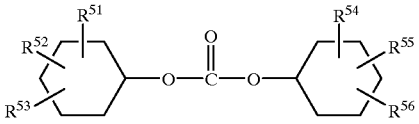

wherein $R^{51}$ $R^{52}$, $R^{53}$, $R^{54}$, $R^{55}$, and $R^{56}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(18)

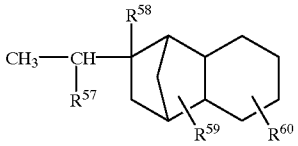

wherein $R^{57}$ and $R^{58}$ are both hydrogen or either one of them is hydrogen and the other is methyl, and $R^{59}$ and $R^{60}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(19)

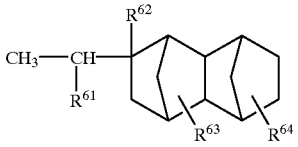

wherein $R^{61}$ and $R^{62}$ are both hydrogen or either one of them is hydrogen and the other is methyl, and $R^{63}$and $R^{64}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(20)

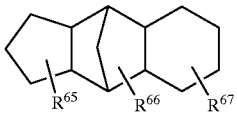

wherein $R^{65}$, $R^{66}$, and $R^{67}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(21)

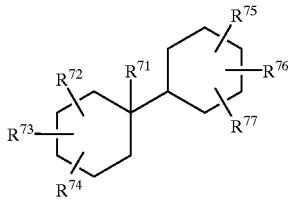

wherein $R^{71}$ is an alkyl group, which may have a naphthenic ring, having 1 to 8 carbon atoms, preferably an alkyl group having 1 to 4 carbon atoms, and more preferably methyl, and $R^{72}$, $R^{73}$, $R^{74}$, $R^{75}$, $R^{76}$, and $R^{77}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl;

(22)

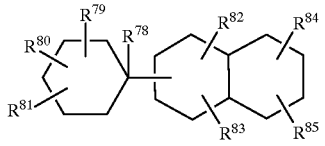

wherein $R^{78}$ is an alkyl group, which may have a naphthenic ring, having 1 to 8 carbon atoms, preferably an alkyl group having 1 to 4 carbon atoms, and more preferably methyl, and $R^{79}$, $R^{80}$, $R^{81}$, $R^{82}$, $R^{83}$, $R^{84}$, and $R^{85}$ are each independently hydrogen or an alkyl group, which may have a naphthenic ring, having 1 to 8 carbon atoms, preferably hydrogen or an alkyl group having 1 to 4 carbon atoms, and more preferably hydrogen or methyl; and (23)

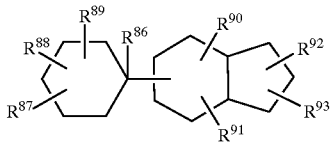

wherein $R^{86}$ is an alkyl group, which may have a naphthenic ring, having 1 to 8 carbon atoms, preferably an alkyl group having 1 to 4 carbon atoms, and more preferably methyl, and $R^{87}$, $R^{88}$, $R^{89}$, $R^{90}$, $R^{91}$, $R^{92}$, and $R^{93}$are each independently hydrogen or an alkyl group, which may have a naphthenic ring, having 1 to 8 carbon atoms, preferably hydrogen or an alkyl group having 1 to 4 carbon atoms, and more preferably hydrogen or methyl.

Specific examples of an alkyl group, which may have a naphthenic ring, having 1 to 8 carbon atoms for $R^9$ through $R^{56}$, $R^{59}$, $R^{60}$, and $R^{63}$ through $R^{93}$ in formulae (12) through (23) representing synthetic oils are alkyl groups, which may be straight-chain or branched, such as methyl, ethyl, propyl, butyl, pentyl, hexyl, heptyl, and octyl groups; (alkyl) cyclopentylalkyl groups, of which the alkyl group may be straight-chain or branched and bonded to any position of the cyclohexyl group, such as cyclopentylmethyl, cyclopentylethyl, cyclopentylpropyl, methylcyclopentylmethyl, ethylcyclopentylmethyl, dimethylcyclopentylmethyl, and methylcyclopentylethyl groups; (alkyl)cyclohexylalkyl groups, of which alkyl group may be straight-chain or branched and bonded to any position of the cyclohexyl group, such as cyclohexylmethyl, cyclohexylethyl, and methylcyclohexylmethyl groups; and (alkyl)cycloheptylalkyl groups, of which the alkyl group may be straight-chain or branched and bonded to any position of the cycloheptyl group, such as cycloheptylmethyl group.

No particular limitation is imposed on the amount of Component (A) in the traction drive fluid of the present invention. However, Component (A) is contained in an amount of 1 to 99 percent by mass, preferably 5 to 95 percent by mass, based on the total weight of the fluid with the objective of enhancing low-temperature flowability and viscosity-temperature properties.

The traction drive fluid of the present invention contains preferably (B) a viscosity-index improver.

viscosity index improvers (Component (B)) which may be used in the present invention are non-dispersion type and/or dispersion type viscosity index improvers.

Specific examples of the non-dispersion type- viscosity index improvers are (B-1) polymers or copolymers of one or more monomers selected from the group consisting of compounds represented by formulae (24), (25) and (26) below, and hydrides of the polymers or the copolymers:

(24)

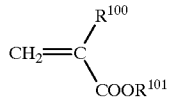

(25)

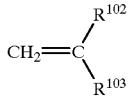

(26)

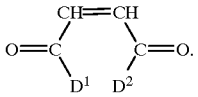

Specific examples of the dispersion type-viscosity index improvers are copolymers of two or more monomers selected from the group consisting of compounds represented by formulae (27) and (28) below; ones obtained by introducing an oxygen-containing group into hydrides of the copolymers; copolymers of one or more monomers selected from the group consisting of compounds represented by formulae (24), (25) and (26) above with one or more monomers (B-2) selected from the group consisting of compounds represented by formulae (27) and (28) below; and hydrides of the copolymers:

(27)

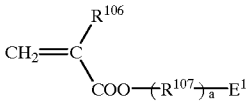

-continued (28)

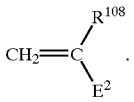

In formula (24), $R^{100}$ is hydrogen or methyl, and $R^{101}$ is an alkyl group having 1 to 18 carbon atoms.

Specific examples of the alkyl group having 1 to 18 carbon atoms for $R^{101}$ are alkyl groups, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

In formula (25), $R^{102}$ is hydrogen or methyl, and $R^{103}$ is hydrogen or a hydrocarbon group having 1 to 12 carbon atoms.

Specific examples of a hydrocarbon group having 1 to 12 carbon atoms are alkyl groups, which may be straight-chain or branched, such as methyl, ethyl, propyl, butyl, pentyl, hexyl, heptyl, octyl, nonyl, decyl, undecyl, and dodecyl groups; alkenyl groups, which may be straight-chain or branched and the position of which the double bond may vary, such as butenyl, pentenyl, hexenyl, heptenyl, octenyl, nonenyl, decenyl, undecenyl, and dodecenyl groups; cycloalkyl groups having 5 to 7 carbon atoms, such as cyclopentyl, cyclohexyl, and cycloheptyl groups; alkylcycloalkyl groups, of which the alkyl group may bonded to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups; aryl groups such as phenyl and naphtyl groups; alkylaryl groups, of which the alkyl group may be straight-chain or branched and bond to any position of the aryl group, having 7 to 12 carbon groups, such as tolyl, xylyl, ethylphenyl, propylphenyl, butylphenyl, pentylphenyl, and hexylphenyl groups; and phenylalkyl groups, of which the alkyl group may be straight-chain or branched, having 7 to 12 carbon atoms, such as benzyl, phenylethyl, phenylpropyl, phneylbutyl, phenylpentyl, and phenylhexyl groups.

In formula (26), $D^1$ and $D^2$ are each independently hydrogen or a residue of an alkylalcohol having 1 to 18 carbon atoms represented by the formula —$OR^{104}$ wherein $R^{104}$ is an alkyl group having 1 to 18 carbon atoms or a residue of a monoalkylamine having 1 to 18 carbon atoms represented by the formula -$NHR^{105}$ wherein $R^{105}$ is an alkyl group having 1 to 18 carbon atoms.

In formula (27), $R^{106}$ is hydrogen or methyl, $R^{107}$ is an alkylene group having 1 to 18 carbon atoms, $E^1$ is an amine residue or heterocyclic residue having 1 or 2 nitrogen and 0 to 2 oxygen, and a is an integer of 0 or 1.

Specific examples of the alkylene group having 1 to 18 carbon atoms for $R^{107}$ are ethylene, propylene, butylene, pentylene, hexylene, heptylene, octylene, nonylene, decylene, undecylene, dodecylene, tridecylene, tetradecylene, pentadecylene, hexadecylene, heptadecylene, and octadecylene groups, all of which may be straight-chain or branched.

Specific examples of a group represented by $E^1$ are dimethylamino, diethylamino, dipropylamino, dibutylamino, anilino, toluidino, xylidino, acetylamino, benzoilamino, morpholino, pyrolyl, pyridyl, methylpydidyl, pyrolidinyl, piperidinyl, quinonyl, pyrrolidonyl, pyrrolidono, imidazolino, and pyrazino groups.

In formula (28), $R^{108}$ is hydrogen or methyl, and $E^2$ is an amino- or heterocyclic-residue having 1 or 2 nitrogen and 0 to 2 oxygen.

Specific examples of a group represented by $E^2$ are dimethylamino, diethylamino, dipropylamino, dibutylamino, anilino, toluidino, xylidino, acetylamino, benzoilamino, morpholino, pyrolyl, pyridyl, methylpydidyl, pyrolidinyl, piperidinyl, quinonyl, pyrrolidonyl, pyrrolidono, imidazolino, and pyrazino groups.

Preferred monomers for Component (B-1) are alkylacrylates having 1 to 18 carbon atoms, alkylmethacrylates having 1 to 18 carbon atoms, olefins having 2 to 20 carbon atoms, styrene, methylstyrene, maleic anhydride ester, maleic abhydride amide, and mixtures thereof.

Preferred monomers for Component (B-2) are dimethylaminomethylmethacrylate, diethylaminomethylmethacrylate, dimethylaminoethylmethacrylate, diethylaminoethylmethacrylate, 2-methyl-5-vinylpyridine, morpholinomethylmethacrylate, morpholinoethylmethacrylate, N-vinylpyrrolidone, and mixtures thereof.

When one or more monomers selected from compounds (B-1) is copolymerized with one or more monomers selected from compounds (B-2), the molar ratio of (B-1) to (B-2) is arbitrary selected but is within the range of 80:20 to 95:5. Although no particular limitation is imposed on the copolymerization method, such copolymers are generally obtained by radical-solution polymerization of Component (B-1) with Component (B-2) in the presence of a polymerization initiator such as benzoyl peroxide.

Specific examples of the viscosity index improvers are non-dispersion type- and dispersion type-polymethacrylates, non-dispersion type- and dispersion type- ethylene-α-olefin copolymers and hydrides thereof, polyisobutylene and hydrides thereof, styrene-diene hydrogenated copolymers, styrene-maleic anhydrides copolymers, and polyalkylstyrene.

Addition of one or more compounds selected from Components (B), i.e., viscosity index improvers makes it possible to enhance viscosity at elevated temperatures particularly required for an automobile traction drive fluid and improve the balance of the same with low-temperature flowability.

In general, the viscosity index improver is used together with a solvent for synthesis thereof. In the present invention, preferred solvents for synthesizing the viscosity index improver are naphthenic compounds represented by formulae (6) through (8), and (10) and (11), isobuten oligomer or hydrides thereof, and compounds represented by formulae (12) through (23).

The molecular weight of Component (B) is preferably selected in view of shear stability. Specifically, it is desired that the dispersion type and non-dispersion type- polymethacrylates have a molecular weight of 5,000 to 150,000, preferably 5,000 to 35,000. It is also desired that the polyisobutylnes and hydrides thereof have a molecular weight of 800 to 5,000, preferably 2,000 to 4,000. Polyisobutylenes and hydrides thereof having a number-average molecular weight of less than 800 would reduce the thickening properties and traction coefficient of the resulting traction drive fluid, while those having a number-average molecular weight in excess of 5,000 would deteriorate the shear stability and low-temperature flowability of the resulting traction drive fluid.

Ethylene-α-olefin copolymers and hydrides thereof having a number average molecular weight of less than 800 would reduce the thickening properties and traction coefficient of the resulting traction drive fluid, while those having a number average molecular weight in excess of 150,000 would deteriorate the shear stability of the resulting traction drive fluid.

No particular limitation is imposed on the content of ethylene component. However, the content of ethylene component is within the range of preferably 30 to 80 percent by mole, and more preferably 50 to 80 percent by mole. Eligible α-olefins are propylene and 1-butene. The former is more preferred.

No particular limitation is imposed on the content of Component (B). In general, it is contained in an amount of preferably 0.1 to 20 percent by mass, more preferably 0.1 to 10 percent by mass, based on the total mass of a traction drive fluid. A content of Component (B) in excess of 20 percent by mass would reduce the traction coefficient of the resulting traction drive fluid, while that less than 0.1 percent by mass would result in poor effect.

A traction drive fluid according to the present invention contains preferably an ashless dispersant hereinafter referred to as Component (C) and a phosphorus additive hereinafter referred to as Component (D).

Addition of Components (C) and (D) can provide the resulting traction drive fluid with anti-wear properties, oxidation stability, and detergency which are required for hydraulic pressure controlling mechanisms.

In the present invention, eligible ashless dispersants (Component (C)) are nitrogen-containing compounds having at least one alkyl or alkenyl group having 40 to 400 carbon atoms, derivatives thereof, and modified products of alkenyl succinimides having at least one alkyl or alkenyl group having 40 to 400 carbon atoms per molecule. One or more members arbitrary selected from these compounds are blended wit a traction drive fluid according to the present invention.

The alkyl and alkenyl groups may be straight-chain or branched. Preferred are branched alkyl and alkenyl groups derived from oligomers of olefins such as propylene, 1-butne, and isobutylene or cooligomers of ethylene and propylene.

The alkyl and alkenyl groups have 40 to 400 carbon atoms, preferably 60 to 350 carbon atoms. Alkyl and alkenyl groups having fewer than 40 carbon atoms would result in a compound having poor solubility to a lubricating base oil, those having over 400 carbon atoms would deteriorate the low temperature flowability of the resulting traction drive fluid.

No particular limitation is imposed on the nitrogen-content of the nitrogen-containing compound which is an example of Component (C). However, the content is within the range of 0.01 to 10 percent by mass, preferably 0.1 to 10 percent by mass, with the objective of wear resistance, oxidation stability, and friction properties.

Specific examples of Component (C) are one or more compounds selected from the followings:

(C-1) succinimides havingat least onealkyl or alkenyl group having 40 to 400 carbon atoms and derivatives thereof;

(C-2) benzylamines having at least one alkyl or alkenyl group having 40 to 400 carbon atoms and derivatives thereof; and (C-3) polyamines having at least one alkyl or alkenyl group having 40 to 400 carbon atoms and derivatives thereof.

Specific examples of (C-1) succinimides are compounds represented by the formulae (29)

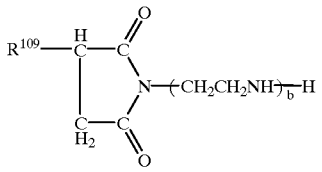

wherein $R^{109}$ is an alkyl or alkenyl group having 40 to 400, preferably 60 to 350 carbon atoms, and b is an integer of 1 to 5, preferably 2 to 4; and (30)

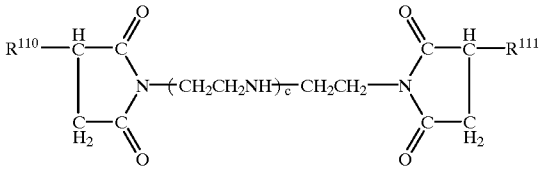

wherein $R^{110}$ and $R^{111}$ are each independently an alkyl or alkenyl group having 40 to 400, preferably 60 to 350 carbon atoms, and c is an integer of 0 to 4, preferably 1 to 3.

Succinimides can be classified as mono-type succinimides, as represented by formula (29), in which succinic anyhydride is added to one end of a polyamine and bis-type succinimides, as represented by formula (30), in which succinic anhydride is added to both ends of a polyamine. Both types of succinimides and mixtures thereof are eligible as Component (C-1).

Specific examples of (C-2) benzylamines are compounds represented by the formula (31)

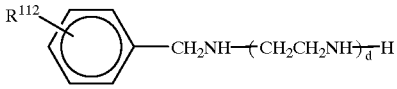

wherein $R^{112}$ is an alkyl or alkenyl group having 40 to 400, preferably 60 to 350 carbon atoms, and d is an integer of 1 to 5, preferably 2 to 4.

No particular limitation is imposed on a method for producing benzylamines. For example, benzylamines may be produced by reacting phenol with a polyolefin such as propylene oligomer, polybutene, and ethylene-α-copolymer to obtain an alkyphenol and then subjecting it to Mannich reaction with formaldhyde and a polyamine such as diethylenetriamine, triethylenetetraamine, tetraethylenepentamine, and pentaethylenehexamine.

Specific examples of (C-3) polyamines are compounds represented by the formula (32)

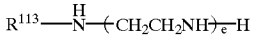

wherein $R^{113}$ is an alkyl or alkenyl group having 40 to 400, preferably 60 to 350 carbon atoms, and e is an integer of 1 to 5, preferably 2 to 4.

No particular limitation is imposed on a method for producing such polyamines. For Example, polyamines may be produced by chloridizing a polyolefin such as propylene oligomer, polybutene, and an ethylene-α-copolymer and then reacting the resulting product with ammonia or a polyamine such as ethylenediamine, diethylenetriamine, triethylenetetramine, tetraethylenepentamine, and pentaethylenehexamine.

Derivatives of the nitrogen-containing compounds which is one example of Component (C) may be (i) an acid-modified compound obtained by allowing the above-described nitrogen-containing compound to react with monocarboxylic acid having 2 to 30 carbon atoms, such as fatty acid or polycarboxylic acid having 2 to 30 carbon atoms, such as oxalic acid, phthalic acid, trimellitic acid, and pyromellitic acid to neutralize the whole or part of the remaining amino and/or imino groups; (ii) a boron-modified compound obtained by allowing the above-described nitrogen-containing compound to react with boric acid to neutralize the whole or part of the remaining amino and/or imino groups; (iii) a sulfur-modified compound obtained by allowing the above-described nitrogen-containing compound to react with a sulfuric compound; and (iv) a modified compound obtained by two or more combination of acid-, boric acid-, and sulfur-modifications of the above-described nitrogen-containing compound.

No particular limitation is imposed on the content of Component (C) in a traction drive fluid according to the present invention. However, in general, Component (C) is contained in an amount of preferably 0.01 to 10.0 percent by mass, and more preferably 0.1 to 7.0 percent by mass, based on the total mass of a traction drive fluid. A content of Component (C) less than 0.01 percent by mass would be less effective in detergency, while a content in excess of 10.0 percent by mass would extremely deteriorate flowability at low temperatures.

Phosphorus additives (Component (D)) which may be used in the present invention are zinc alkyldithiophosphate, phosphoric acid, phosphorous acid, monophosphates, diphosphates, triphosphates, monophosphites, diphosphites, triphosphites, salts of phosphates and phosphites, and mixtures thereof.

These exemplified compounds, besides phosphoric acid and phosphorus acid, are compounds having a hydrocarbon group having 2 to 30, preferably 3 to 20 carbon atoms.

Specific examples of the hydrocarbon group having 2 to 30 are alkyl groups which may be straight-chain or branched, such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups; alkenyl groups, which may be straight-chain or branched and the position of which the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl groups; cycloalkyl groups having 5 to 7 carbon atoms, such as cyclopentyl, cyclohexyl, and cycloheptyl groups; alkylcycloalkyl groups, of which the cycloalkyl group may possess an alkyl substituent at any position, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; aryl group such as phenyl and naphtyl groups; alkylaryl groups, of which the alkyl group may be straight-chain or branched and may bond to any position of the aryl group, having 7 to 18 carbon atoms, such as tolyl, xylyl, ethylphenyl, propylphenyl, butylphenyl, pentylphenyl, hexylphenyl, heptyl phenyl, octylphenyl, nonylphenyl, decylphenyl, undecylphenyl and dodecylphenyl groups; and arylalkyl groups, of which the alkyl group may be straight-chain or branched, having 7 to 12 carbon atoms, such as benzyl, phenylethyl, phenylpropyl, phenylbutyl, phenylpentyl and phenylhexyl groups.

Preferred compounds for Component (D) are phosphoric acid; phosphorus acid; zinc alkyldithiophosphates, of which the alkyl group may be straight-chain or branched, such as zinc dipropyldithiophosphate, zinc dibutyldithiophosphate, zinc dipentyldithiophospahte, zinc dihexyldithiophospahte, zinc diheptyldithiophospahte, and zinc dioctyldithiophospahte; monoalkyl phosphates, of which the alkyl group may be straight-chain or branched, such as monopropyl phosphate, monobutyl phosphate, monopentyl phosphate, monohexyl phosphate, monoheptyl phospahte and monooctyl phosphate; mono(alkyl)aryl phosphates such as monophenyl phospahte and monocresyl phosphate; dialkyl phosphates, of which the alkyl group may be straight-chain or branched, such as dipropyl phosphate, dibutyl phosphate, dipentyl phospahte, dihexyl phosphate, diheptyl phosphate and dioctyl phospahte; di(alkyl)aryl phosphates such as diphenyl phosphate and dicresyl phospahte; trialkyl phosphates, of which the alkyl group may be straight-chain or branched, such as tripropyl phosphate, tributyl phosphate, tripentyl phosphate, trihexyl phosphate, triheptyl phosphate and trioctyl phosphate; tri(alkyl)aryl phosphates such as triphenyl phosphate and tricresyl phosphate; monoalkyl phosphites, of which the alkyl group may be straight-chain or branched, such as monopropyl phosphite, monobutyl phosphite, monopentyl phosphite, monohexyl phosphite, monoheptyl phosphite and monooctyl phosphite; mono (alkyl)aryl phosphites such as monophenyl phosphite and monocresyl phosphite; dialkyl phosphites, of which the alkyl group may be straight-chain or branched, such as dipropyl phosphite, dibutyl phosphite, dipentyl phosphite, dihexyl phosphite, diheptyl phosphite and dioctyl phosphite; di(alkyl)aryl phosphites such as diphenyl phosphite and dicresyl phosphite; trialkyl phosphites, of which the alkyl group may be straight-chain or branched, such as tripropyl phosphite, tributyl phosphite, tripentyl phosphite, trihexyl phosphite, triheptyl phosphite and trioctyl phosphite; tri (alkyl)aryl phosphites, of which the alkyl group may be straight-chain or branched, such as triphenyl phosphite and tricresyl phosphite; and mixtures thereof.

Specific examples of the salts of phosphites are those obtained by allowing a monophosphate, a diphosphate, a monophosphite, or a diphosphite to react with a nitrogen-containing compound such as ammonia or an amine compound having in its molecules only hydrocarbon or hydroxyl-containing groups having 1 to 8 carbon atoms so as to neutralize the whole or part of the remaining acid hydrogen.

Specific examples of the nitrogen-containing compound are ammonia; alkylamines, of which the alkyl group may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; alkanolamines, of which the alkanol group may be straight-chain or branched, such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

Components (D) may be blended alone or in combination in a traction drive fluid according to the present invention.

Phosphorus compounds referred hereinbelow to as Component (E-2) having its molecules at least one alkyl or alkenyl group having 6–30 carbon atoms but no hydrocarbon groups of more than 31 carbon atoms and derivatives thereof may be used as Component (D) whereby a traction drive fluid according to the present invention can be imparted not only with the aforesaid anti-wear properties but also with optimized friction properties for a wet clutch.

No particular limitation is imposed on the content of Component (D) in a traction drive fluid according to the present invention. However, in general, the content of Component (D) is within the range of preferably 0.005 to 0.2 percent of phosphorus by mass, based on the total mass of a traction drive fluid. The content of Component (D) less than 0.005 percent of phosphorus by mass would be less effective in anti-abrasion properties, while that in excess of 0.2 percent of phosphorus by mass would deteriorate the oxidation stability of the resulting traction drive fluid.

A traction drive fluid according to the present invention contains preferably a friction modifier hereinafter referred to as Component (E).

Component (E) may be various compounds having in their molecules at least one alkyl or alkenyl group having 6 to 30 carbon atoms but no hydrocarbon groups having 31 or more carbon atoms. The addition of Component (E) is contributive to the production of a traction drive fluid having optimized friction properties.

The alkyl or alkenyl groups of Component (E) may be straight-chain or branched but preferred compounds for Component (E) are those having these groups of 6 to 30, preferably 9 to 24 carbon atoms. Departures from the range of the specified carbon number would cause the deterioration of the friction properties of a wet-type clutch.

Specific examples of the alkyl and alkenyl groups are alkyl groups, which may be straight-chain or branched, such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; andalkenyl groups, which may be straight-chain or branched and the position of which the double bond may vary, such as hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups.

Friction modifiers containing a hydrocarbon group of 31 or more carbon atoms are not preferred because they would cause the deterioration of the friction properties in a wet-type clutch.

Specific examples of Component (E) are one or more compounds selected from the followings: (E-1) an amine compound having in its molecules at least one alkyl or alkenyl group having 6 to 30 carbon atoms and no hydrocarbon group having 31 or more carbon atoms, and derivatives thereof; (E-2) a phosphorus compound having in its molecules at least one alkyl or alkenyl group having 6 to 30 carbon atoms and no hydrocarbon group having 31 or more carbon atoms, and derivatives thereof; and (E-3) an amide or metallic salt of a fatty acid having in its molecules at least one alkyl or alkenyl group having 6 to 30 carbon atoms and no hydrocarbon group having 31 or more carbon atoms.

Specific examples of (E-1) a amine compound are aliphatic monoamines represented by formula (33) or alkyleneoxide adducts thereof (33)

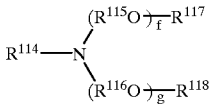

aliphatic polyamines represented by the formula (34)

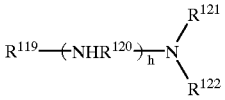

and imidazoline compounds represented by the formula (35)

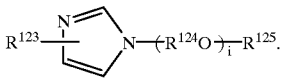

In formula (33), $R^{114}$ is an alkyl or alkenyl group having 6 to 30, preferably 9 to 24 carbon atoms, $R^{115}$ and $R^{116}$ are each independently ethylene or propylene, $R^{117}$ and $R^{118}$ are each independently hydrogen or a hydrocarbon group having 1 to 30 carbon atoms, f and g are each independently an integer of 0 to 10, preferably 0 to 6, and f+g=0 to 10, preferably 0 to 6.

In formula (34), $R^{119}$ is an alkyl or alkenyl group having 6 to 30, preferably 9 to 24 carbon atoms, $R^{120}$ is ethylene or propylene, $R^{121}$ and $R^{122}$ are each independently hydrogen or a hydrocarbon group having 1 to 30 carbon atoms, h is an integer of 1 to 5, preferably 1 to 4.

In formula (35), $R^{123}$ is an alkyl or alkenyl group having 6 to 30, preferably 9 to 124 carbon atoms, $R^{124}$ is ethylene or propylene, $R^{125}$ is hydrogen or a hydrocarbon group having 1 to 30 carbon atoms, and i is an integer of 0 to 10, preferably 0 to 6.

The alkyl and alkenyl groups for $R^{114}$, $R^{119}$, and $R^{123}$ may be straight-chain or branched ones but have 6 to 30, preferably 9 to 24 carbon atoms. Alkyl or alkenyl groups having fewer than 6 carbon atoms or having over 30 carbon atoms are not preferred because they cause the deterioration of friction properties in a wet clutch.

Specific examples of the alkyl or alkenyl groups for $R^{114}$, $R^{119}$, and $R^{123}$ are various alkyl and alkenyl groups as described above. Particularly preferred are straight-chain alkyl or alkenyl groups having 12 to 18 carbon atoms, such as laulyl, myristyl, palmityl, stearyl, and oleyl groups because excellent friction properties in a wet-type clutch can be achieved.

Specific examples of a group for each $R^{117}$, $R^{118}$, $R^{121}$, $R^{122}$, and $R^{125}$ are hydrogen; straight or branched alkyl groups, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; alkenyl groups, which may be straight-chain or branched and wherein the position of the double bond may vary, such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl and triacontenyl groups; cycloalkyl groups having 5 to 7 carbon atoms, such as cyclopentyl, cyclohexyl and cycloheptyl groups; alkylcycloalkyl groups, of which the alkyl group may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; aryl groups such as phenyl and naphtyl groups; alkylaryl groups, of which the alkyl group may be straight-chain or branched and may bond to any position of the aryl group, having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and arylalkyl groups, of which the alkyl group may be straight-chain or branched, having 7 to 12 carbon atoms, such as benzyl, phenylethyl, phenylpropyl, phenylbutyl, phenylpentyl and phenylhexyl groups.

Because of their good friction properties in a wet type clutch, preferred aliphatic monoamines or alkyleneoxide adducts thereof are those of formula (33) wherein $R^{117}$ and $R^{118}$ are each independently hydrogen or an alkyl group having 1 to 6 carbon atoms, and f=g=0, and alkyleneoxide adducts of aliphatic monoamines of formula (33) wherein both $R^{117}$ and $R^{118}$ are hydrogen, and f and g are each independently an integer of 0 to 6 and f+g=1 to 6.

Because of the good friction properties in a wet type clutch with, preferred aliphatic polyamines are those of formula (34) wherein $R^{121}$ and $R^{122}$ are each independently hydrogen or an alkyl group having 1 to 6 carbon atoms.

Because of the good friction properties in a wet type clutch with, preferred imidazoline compounds are those of formula (35) wherein $R^{125}$ is hydrogen or an alkyl group having 1 to 6 carbon atoms.

Derivatives of amine compounds referred to as (E-1) may be (i) an acid-modified compound obtained by allowing the above-described amine compound of formula (33), (34) or (35) to react with monocarboxylic acid (aliphatic acid) having 2 to 30 carbon atoms or polycarboxylic acid having 2 to 30 carbon atoms, such as oxalic acid, phthalic acid, trimellitic acid, and pyromellitic acid so as to neutralize the whole or part of the remaining amino and/or imino groups; (ii) a boron-modified compound obtained by allowing the above-described amine compound of formula (33), (34) or (35) to react with boric acid so as to neutralize the whole or part of the remaining amino and/or imino groups; (iii) a salt of phosphate obtained by allowing the above-described amine compound of formula (33), (34) or (35) to react with acid phosphate or acid phosphite each having in its molecules one or two hydrocarbon groups having 1 to 30 carbon atoms but no hydrocarbon group having 31 or more carbon atoms and having at least one hydroxyl group so as to neutralize the whole or part of the remaining amino or imino groups; (iv) an alkyleneoxide adduct of an amine compound obtained by allowing the amine compound of formula (34) or (35) to react with an alkylene oxide such as ethylene oxide and propylene oxide; and (v) a modified product of an amine compounds obtained by subjecting an amine compound to two or more of the aforesaid modifications.

In view of the capability to provide excellent friction properties in a wet clutch, specific examples of the amine compound (E-1) and derivatives thereof are amine compounds such as lauryl amine, lauryl diethylamine, lauryl diethanolamine, dodecyldipropanolamine, palmitylamine, stearylamine, stearyltetraethylenepentamine, oleylamine, oleylpropylenediamine, oleyldiethanolamine, N-hydroxyethyloleylimidazolyne; alkyleneoxide adducts of these amine compounds; salts of these amine compounds and acid phosphate such as di-2-ethylhexylphosphate or acid phosphite such as 2-ethylhexylphosphite; a boric acid-modified product of these amine compounds, alkyleneoxide adducts of these amine compounds or phosphites of these amine compounds; and mixtures thereof.

Specific examples of the phosphorus compound (E-2) are phosphates represented by formula (36) below and phosphites represented by formula (37) below (36)

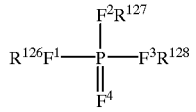

and (37)

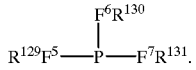

In formula (36), $R^{126}$ is an alkyl or alkenyl group having 6 to 30, 9 to 24 carbon atoms, $R^{127}$ and $R^{128}$ each independently hydrogen or a hydrocarbon group having 1 to 30 carbon atoms, $F^1$, $F^2$, $F^3$, and $F^4$ are each independently oxygen or sulfur, provided that at least one of $F^1$, $F^2$, $F^3$, and $F^4$ is oxygen.

In formula (37), $R^{129}$ is an alkyl or alkenyl group having 6 to 30, preferably 9 to 24 carbon atoms, $R^{130}$ and $R^{131}$ are each independently hydrogen or a hydrocarbon group having 1 to 30 carbon atoms, $F^5$, $F^6$, and $F^7$ are each independently oxygen or sulfur provided that at least one of $F^5$, $F^6$, and $F^7$ is oxygen.

The alkyl and alkenyl group for $R^{126}$ and $R^{129}$ may be straight-chain or branched ones having 6 to 30, preferably 9 to 24 carbon atoms.

Departures from the above-specified range of carbon number would cause a deterioration in friction properties in a wet clutch.

Specific examples of the alkyl and alkenyl groups are the above-described various alkyl and alkenyl groups, among which preferred are straight-chain alkyl and alkenyl groups having 12 to 18 carbon atoms, such as laulyl, myristyl, palmityl, stearyl, and oleyl groups in view of the capability of providing the resulting traction drive fluid with excellent friction properties in a wet-type clutch.

Specific examples of a group for each $R^{127}$, $R^{128}$, $R^{130}$, and $R^{131}$ are hydrogen; alkyl groups, which may be straight-chain or branched, such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl and triacontyl groups; alkenyl group, which may be straight-chain or branched and the position of which the double bond may vary, butenyl, pentenyl, hexenyl, heptenyl, octenyl, nonenyl, decenyl, undecenyl, dodecenyl, tridecenyl, tetradecenyl, pentadecenyl, hexadecenyl, nonadecenyl, eicocenyl, heneicocenyl, dococenyl, tricocenyl, tetracocenyl, pentacocenyl, hexacocenyl, heptacocenyl, octacocenyl, nonacocenyl and triacontenyl groups; cycloalkyl groups having 5 to 7 carbon atoms, such as cyclopentyl, cyclohexyl and cycloheptyl groups; alkylcycloalkyl groups, of which the alkyl group may bond to any position of the cycloalkyl group, having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl and diethylcycloheptyl groups; aryl groups, such as phenyl and naphtyl groups; alkylaryl groups, of which the alkyl group may be straight-chain or branched and may bond to any position of the aryl group, having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups; and arylalkyl groups, of which alkyl group may be straight-chain or branched, having 7 to 12 carbon atoms, such as benzyl, phenylethyl, phenylpropyl, phenylbutyl, phenylpentyl and phenylhexyl groups.

In view of the capability of providing the resulting traction drive fluid with excellent friction properties in a wet-type clutch, preferred phosphorus compounds as Component (E-2) are acid phosphates represented by formula (36) wherein at least one of $R^{127}$ and $R^{128}$ is hydrogen and acid phosphites represented formula (37) wherein at least one of $R^{130}$ and $R^{131}$ is hydrogen.

Specific examples of the derivatives of the phosphoric compounds also referred to as Component (E-2) are salts obtained by allowing an acid phosphite of formula (36) wherein at least one of $R^{127}$and $R^{128}$ is hydrogen or an acid phosphite of formula (37) wherein at least one of $R^{130}$ and $R^{131}$ is hydrogen to react with a nitrogen-containing compound such as ammonia or an amine compound having in its molecules only hydrocarbon or hydroxyl-containing groups having 1 to 8 carbon atoms so as to neutralize the whole or part of the remaining acid hydrogen.

Specific examples of such a nitrogen-containing compound are ammonia; alkylamines, of which the alkyl group may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; alkanolamines, of which the alkanol group may be straight-chain or branched, such as monomethanolamine, monoethanolamine, monopropanolamine, monobutanolamine, monopentanolamine, monohexanolamine, monoheptanolamine, monooctanolamine, mononononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine and dioctanolamine; and mixtures thereof.

In view of the capability to provide the resulting traction drive fluid with excellent friction properties in a wet-type clutch, particularly preferred phosphorus compounds as Component (E-2) are monolauryl phosphate, dilauryl phosphate, monostearyl phosphate, distearyl phosphate, monooleyl phosphate, dioleyl phosphate, monolauryl phosphate, dilauryl phosphite, monostearyl phosphite, distearyl phosphite, monooleyl phosphite, dioleylphosphite, monolauryl thiophosphate, dilauryl thiophosphate, monostearyl thiophosphate, distearyl thiophosphate, monooleyl thiophosphate, dioleyl thiophosphate, monolauryl thiophosphate, dilauryl thiophosphite, monostearyl thi.ophosphite, distearyl thiophosphite, monooleyl thiophosphite, dioleyl thiophosphite; amine salts of these phosphates such as mono2-ethylhexylamine salts, phosphite, thiophosphate and thiophosphite; and mixtures thereof.

The fatty acid amide or fatty metal salt referred to as Component (E-3) may be straight-chain or branched and saturated or unsaturated fatty acids but the alkyl group or alkenyl group thereof has 6 to 30, preferably 9 to 24 carbon atoms. Fatty acids having an alkyl or alkenyl group having fewer than 6 or 31 or greater carbon atoms are not preferred because they would cause the deterioration of friction properties in a wet-type clutch.

Specific examples of the fatty acid are straight-chain or branched saturated fatty acids, such as heptanoic acid, octanonic acid, nonanoic acid, decanoic acid, undecanoic acid, dodecanoic acid, tridecanoic acid, tetradecanoic acid, pentadecanoic acid, hexadecanoic acid, heptadecanoic acid, octadecanoic acid, nonadecanoic acid, icosanoic acid, henicosanoic acid, docosanoic acid, tricosanoic acid, tetracosanoic acid, pentacosanoic acid, hexacosanoic acid, heptacosanoic acid, octacosanoic acid, nonacosanoic acid and triacontanoic acid; and straight-chain or branched unsaturated fatty acids, wherein the position the double bond may vary, such as heptanoic acid, octenoic acid, nonenoic aicd, decenoic acid, undecenoic acid, dodecenoic acid, tridecenoic acid, tetradecenoic acid, pentadecenoic acid, hexadecenoic acid, heptadecenoic acid, octadecenoic acid, nonadecenoic acid, eicosenoic acid, heneicosenoic acid, docosenoic acid, tricosenoic acid, tetracosenoic acid, pentasenoic acid, hexacosenoic acid, heptacosenoic acid, octacosenoic acid, nonacosenoic acid and triacontenoic acid. In view of the capability of providing excellent friction properties in a wet-type clutch, particularly preferred fatty acids are straight-chain fatty acids derived from various types of fats and oils such as lauric acid, myristic acid, palmitic acid, stearic acid and oleic acid and mixtures of straight-chain fatty acid and branched fatty acid obtained by the oxo synthesis.

The fatty acid amide referred to as Component (E-3) may be amides obtained by reacting a nitrogen-containing compound such as ammonia and amine compound having per molecule only hydrocarbon or hydroxyl-containing hydrocarbon groups having 1 to 8 carbon atoms.

Specific examples of such a nitrogen-containing compound are ammonia; alkylamine, of which the alkyl group may be straight-chain or branched, such as monomethylamine, monoethylamine, monopropylamine, monobutylamine, monopentylamine, monohexylamine, monoheptylamine, monooctylamine, dimethylamine, methylethylamine, diethylamine, methylpropylamine, ethylpropylamine, dipropylamine, methylbutylamine, ethylbutylamine, propylbutylamine, dibutylamine, dipentylamine, dihexylamine, diheptylamine and dioctylamine; and alkanolamines, of which the alkanol group may be straight-chain or branched, such as monomethanolamine, monoethanolamine, monopropanolamine, monobutanolamine, monopentanolamine, monohexanolamine, monoheptanolamine, monooctanolamine, monononanolamine, dimethanolamine, methanolethanolamine, diethanolamine, methanolpropanolamine, ethanolpropanolamine, dipropanolamine, methanolbutanolamine, ethanolbutanolamine, propanolbutanolamine, dibutanolamine, dipentanolamine, dihexanolamine, diheptanolamine, and dioctanolamine.

With the objective of providing excellent friction properties in a wet-type clutch, specific examples of the fatty acid amides as Component (E-3) are lauric acid amide, lauric acid diethanolamide, lauric monopropanolamide, myristic acid amide, myristic acid diethanolamide, myristic acid monopropanolamide, palmitic acid amide, palmitic acid ethanolamide, palmitic acid monopropanolamide, stearic acid amide, stearic acid diethanolamide, stearic acid monopropanolamide, oleic acid amide, oleic acid diethanolamide, oleic acid monopropanol amide, coconut oil fatty amide, coconut oil fatty acid diethanolamide, coconut oil fatty monopropanolamide, synthetic mixed fatty amides having 12 to 13 carbon atoms, synthetic mixed fatty diethanolamides having 12 to 13 carbon atoms, synthetic mixed fatty monopropanolamides having 12 to 13 carbon atoms, and mixtures thereof.

Specific examples of the fatty metallic acid also referred to as Component (E-3) are alkaline earth metal salts such as a magnesium salt and a calcium salt, and a zinc salt of any of the above-exemplified fatty acids.

With the objective of excellent friction properties in a wet-type clutch, particularly preferred fatty acid metallic salts are calcium laurate, calcium myristate, calcium palmitate, calcium stearate, calcium oleate, coconut oil fatty acid calcium, synthetic mixed fatty acid calcium having 12 to 13 carbon atoms, zinc laurate, zinc myristate, zinc palmitate, zinc stearate, zinc oleate, coconut oil fatty zinc, synthetic mixed fatty zinc having 12 to 13 carbon atoms, and mixtures thereof.

Any one or more members arbitrary selected from the above-described Components (E) may be added to a traction drive fluid according to the present invention in any suitable amount as long as they do not adversely affect the other properties of the resulting fluid such as oxidation stability. In order to obtain long-lasting friction properties of the fluid, it is necessary to avoid a deterioration in friction properties caused by the deterioration of Component (E). Addition of large amounts of Component (E) is effective in obtaining long-lasting friction properties. However, too large amounts of component (E) would lead to reduced static friction coefficient which is required to be high so as to maintain the coupling or engagement of a wet-type clutch. The amount of Component (E) is thus limitedto some extent. Therefore, thecontent of Component (E) is within the range of preferably 0.005 to 3.0 mass percent, preferably 0.01 to 2.0 mass percent, based on the total mass of a traction drive fluid.

When there arises a necessity of adding Component (E) in an amount exceeding such a limit so as to improve the long lasting friction properties, the traction drive fluid of the present invention may be blended with an additive for enhancing friction coefficient , hereinafter referred to as Component (G).

Compound (G) may be exemplified by the following compounds:

(G-1) a compound having the same polar group as those of Component (E) and a lipophilic group which is a hydrocarbon group having 100 or fewer carbon atoms; and (G-2) a nitrogen-containing compound such as succinimide- and succinamide- compounds or a compound obtained by modifying the nitrogen-containing compound with a boron compound such as boric acid or a sulfuric compound.

When Components (E) and (G) are used in combination in a traction drive fluid according to the present invention, the content of Component (G) is within the range of preferably 0.1 to 10.0 percent by mass, more preferably 0.5 to 3.0 percent by mass, based on the total mass of the traction drive fluid. A content of Component (G) less than 0.1 percent by mass would be less effective in increasing static friction coefficient, while a content in excess of 10.0 percent by mass would cause the deterioration of low-temperature flowability and oxidation stability.

A traction drive fluid according to the present invention contains preferably a metallic detergent hereinafter referred to as Component (F). Addition of Component (F) makes it possible to optimize the friction properties in a wet-type clutch and restrict a reduction in strength thereof which reduction is caused by pressure being applied thereto repeatedly.

Preferred metallic detergents are basic metallic detergents having a total base number of 20 to 450 mgKOH/g, preferably 50 to 400mgKOH/g. The term "total base number" used herein denotes a total base number measured by the perchloric acid potentiometric titration method in accordance with section 7 of JIS K2501 "Petroleum products and lubricants-Determination of neutralization number".

Metallic detergents having a total base number of less than 20 mgKOH/g would be less effective in inhibiting a wet-type clutch from being reduced in strength due to the repeated compression force applied thereto, while those having a total base number in excess of 450 mgKOH/g would be unstable in structure, leading to a deterioration in the storage stability of the resulting traction drive fluid.

Component (F) may be one or more member selected from the following metal detergents:

(F-1) alkaline earth metal sulfonates of 20 to 450 mgKOH/g in total base number;

(F-2) alkaline earth metal phenates of 20 to 450 mgKOH/g in total base number; and (F-3) alkaline earth metal salicylates of 20 to 450 mgKOH/g in total base number.

Specific examples of the alkaline earth metal sulfonates referred to as Component (F-1) are alkaline earth metal salts preferably magnesium salt or calcium salt of an alkyl aromatic sulfonic acid obtained by sulfonating an alkyl aromatic compound having a molecular weight of 100 to 1,500, preferably 200 to 700. Specific examples of the alkyl aromatic sulfonic acid are petroleum sulfonic acids and synthetic sulfonic acids.

The petroleum sulfonic acid may be mahogany acid obtained by sulfonating the alkyl aromatic compound contained in the lubricant fraction of mineral oil or by-produced upon production of white oil. The synthetic sulfonic acid may be those obtained by sulfonating alkyl benzene having a straight-chain or branched alkyl group, which may be by-produced from a plant for producing alkyl benzene used as materials of detergents, or sulfonating dinonylnaphthalene. Although not restricted, there may be used fuming sulfuric acid and sulfuric acid as a sulfonating agent.

Specific examples of alkaline earth metal phenates referred to as Component (F-2) are alkaline earth metal salts of alkylphenol having at least one straight or branched alkyl group of 4 to 30, preferably 6 to 18 carbon atoms, alkylphenolsulfide obtained by reacting the alkylphenol with elementary sulfur or a product resulting from the Mannich reaction of the alkylphenol with formaldehyde. Particularly preferred are magnesium phenates and/or calcium phenates.

Specific examples of alkaline earth metal salicylates referred to as Component (F-3) are alkaline earth metal salts of alkyl salicylic acid having at least one straight-chain or branched alkyl group of 4 to 30, preferably 6 to 18 carbon atoms. Particularly preferred are magnesium salicylates and/or calcium salicylates.

Components (F-1), (F-2), and (F-3), as long as they have a total base number of 20 to 450 mgKOH/g, may be (i) neutral salts, (ii) basic salts, and (iii) overbased salts. The neutral salts are those produced by reacting a compound such as alkyl aromatic sulfonic acid, alkylphenol, alkylphenol sulfide and the Mannich reaction product of alkylphenol, and alkyl salicylic acid directly with an alkaline earth metal base such as the oxide or hydroxide of an alkaline earth metal such as magnesium and/or calcium or produced indirectly by converting such a compound to an alkali metal salt such as sodium salt or potassium salt and then substituting the alkali metal salt with an alkaline earth metal salt. The basic salts are those obtained by heating such a neutral salt with an excess amount of an alkaline earth metal salt or alkaline earth metal hydroxide or oxide in the presence of water. The overbased salts are those obtained by reacting a neutral salt as obtained above with an alkaline earth metal oxide or hydroxide in the presence of carbon dioxide.

These reactions may be carried out in a solvent, for example, an aliphatic hydrocarbon solvent such as hexane, an aromatic hydrocarbon solvent such as xylene and a light lubricant base oil. Commercially available metallic detergents are usually diluted with a light lubricating base oil. It is preferred to use metallic detergents of which metal content is within the range of 1.0 to 20 percent by mass, preferably 2.0 to 16 percent by mass.

Although not restricted, the content of Component (F) in a traction drive fluid according to the present invention is within the range of 0.01 to 5.0 percent by mass, preferably 0.05 to 4.0 percent by mass, based on the total mass of the fluid. A content less than 0.05 mass percent would be less effective in inhibiting a wet-type clutch from being reduced in strength due to repeatedly applied compression force thereto, while a content greater than 5.0 mass percent would reduce the oxidation stability of the resulting traction drive fluid.

The above-described Components (C), (D), (E) and (F) can provide a traction drive fluid according to the present invention with wear resistance, oxidation stability and detergency all needed for a hydraulic controlling mechanism and friction properties in a wet-type clutch needed for a friction properties controlling mechanism as well as the capability to provide the wet-type clutch with strength against repeatedly applied compression force thereto. For the purpose of further enhancing these properties and improving the resistance to corrosiveness of nonferrous metals such as copper materials as well as durability of resins such as nylon, a traction drive fluid according to the present invention may be added with oxidation inhibitors, extreme pressure agents, corrosion inhibitors, rubber swelling agents, anti-foaming agents and dyes. These additives may be used singlely or in combination.

Oxidation inhibitors may be phenol-based or amine-based compounds such as alkylphenols such as 2-6-di-tert-butyl-4-methylphenol, bisphenols such as methylene-4,4-bisphenol(2,6-di-tert-butyl-4-methylphenol), naphtylamines such as phenyl-α-naphtylamine, dialkyldiphenylamines, zinc dialkyldithiophosphates such as zinc di-2-ethylhexyldithiophosphate, esters of 3,5-di-tert-butyl-4-hydroxyphenyl fatty acid (propionic acid) with a mono- or poly-hydric alcohol such as methanol, octadecanol, 1,6 hexanediol, neopentyl glycol, thiodiethylene glycol, triethylene glycol or pentaerythritol.

One or more of these compounds is preferably added in an amount of 0.01 to 5.0 percent by mass based on the total mass of a traction drive fluid.

Extreme pressure additives may be sulfuric compounds such as disulfides, olefin sulfides, and sulfurized fats and oils. One or more of these compounds is preferably added in an amount of 0.1 to 5.0 percent by mass based on the total mass of a traction drive fluid.

Corrosion inhibitors may be benzotriazoles, tolyltriazoles, thiodiazoles and imidazoles. One or more of these compounds is preferably added in an amount of 0.01 to 3.0 percent by mass based on the total mass of a traction drive fluid.

Anti-foaming agents may be silicones such as dimethylsilicone and fluorosilicone. One or more of these compounds is preferably added in an amount of 0.001–0.05 percent by mass based on the total mass of a traction drive fluid.

Dyes may be added in an amount of 0.001–1.0 mass percent.

As described above, a traction drive fluid according to the present invention has excellent driving force transmitting properties and can posses the properties as a fluid for a hydraulic controlling mechanism and a friction properties controlling mechanism for a wet-type clutch which the conventional commercially available traction drive fluid do not have. Therefore, a traction dive fluid according to the present invention can satisfactorily exhibit its properties as a traction drive fluid for automobiles.

The present invention will be further described by way of the following examples which are provided for illustrative purposes only.

EXAMPLES 1 to 3

Fluids 1, 2, and 3 according to the present invention were prepared by the following manner.

FLUID 1

645 g tricyclopentadiene containing mainly an endo-structure was obtained by reacting 1800 g dicyclopentadiene charged into a 2.5 L volume autoclave at a temperature of 180° C. for 3 hours and vacuum-distilling the reaction product.

All of the resulting tricyclopentadiene was charged into a high-pressure-resistant autoclave for hydrogenation and then hydrogenated by adding 8.5 g of a nickel-diatomite-hydrogenation catalyst which is manufactured under the name of N113 by Nikki-Chemical Co., Ltd. The reactionwas started at a temperatureof 120° C. and a hydrogen pressure of 6 MPa. However, the temperature was raised by heat-generation and thus controlled by cooling with water. After 40 minutes past, since the absorption of the hydrogen was extremely reduced, the hydrogenation was completed after raising the temperature up to 140° C. and conducting the reaction for another one hour.

The resulting hydride was separated from the catalyst and purified by vacuum-distillation thereby obtaining 600 g of a hydrogenated compound which is solid at ordinary temperature. An NMR analysis revealed that the compounds have two kinds of structures represented by formulae (38) and (39) below:

(38)

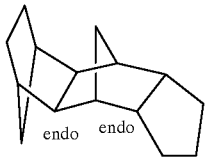

(39)

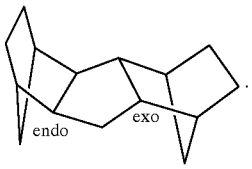

The blend ratio of the compounds of formulae (38) and (39) was 70:30.

Next, isomerization was conducted. On a 2L 4-neck flask were mounted a cooling tube equipped with a 3-way cock having the tip portion connected to a nitrogen line, a dropping funnel, and a thermometer. The flask was filled with nitrogen. Thereafter, 15.3 g of aluminum chloride and 300 ml of methylene chloride were charged into the flask and was maintained at a temperature of 20° C. in a water-bath, followed by adding slowly dropwise 463 g of the above-obtained hydrogenated compound dissolved in 240 ml of methylene chloride through the funnel over one hour. Even thereafter, since a substantial raise in temperature was not observed, the reaction was continued for another 8 hours after heating to 45° C. After the catalyst was deactivated by adding slowly 500 ml of water through the funnel and the water phase was separated, 352 g of Fluid 1 were recovered by distillation. As a result of a gas chromatography analysis, about 5% of the pre-isomerized compound were remained. Fluid 1 was found to contain about 95% of a isomerized compound resulting from the reaction.

FLUIDS 2 and 3

By conducting the above isomerization in which the reaction time was shortened were obtained Fluids 2 and 3 which contain 70% and 40% isomerized compound, respectively.

Tests were conducted to measure the traction coefficient, low-temperature viscosity at −30° C. (Brookfield Viscosity), pour point in accordance with JIS K 2269 of each of Fluids 1, 2, and 3. The results are shown in Table 1. Traction coefficient was measured with a four-roller traction coefficient test apparatus under the following conditions:

Peripheral speed: 5.23 m/s

Oil temperature: 60° C.

Maximum Hertzian contact pressure: 1.10 Gpa

Slip ratio: 2%.

COMPARATIVE EXAMPLES 1 and 2

The same tests were conducted to measure the traction coefficient, low-temperature viscosity at −30° C. (Brookfield viscosity), pour point in accordance with JIS K 2269 of hydrogenated tricyclopentadiene which is the precursor of Fluids 1, 2, and 3 herein after referred to as a pre-isomerized compound and 2-methyl-2,4-dicyclohexylpentane hereinafter referred to as Fluid A which has been used in machines for the industrial use and reputed having high traction coefficient.

TABLE 1

| Sample Oil | Tricyclopentadiene hydride (blend ratio) Compound before isomerization | Compound after isomerization | Traction Coefficient | Low Temperature Viscosity (−30° C.) mPa.s | Pour Point °C. |
|---|---|---|---|---|---|
| Fluid 1 | 5% | 95% | 0.081 | 1900 | −45 or below |
| Fluid 2 | 30% | 70% | 0.081 | 2400 | −40 |
| Fluid 3 | 60% | 40% | 0.080 | — | −10 |
| Pre-isomerized Compound | 100% | — | — | — | 45 or higher |
| Fluid A | — | | 0.099 | 30000 | −45 or below |

EXAMPLES 4 to 6

Various mixed fluids 4, 5, and 6 were prepared by mixing Fluids 1, 2, 3, and A in accordance with the formulations shown in Table 2. The traction coefficient and low-temperature viscosity at −30° C. of each of Fluids 4, 5, and 6 were measured. The results are also shown in Table 2.

TABLE 2

| | Composition (mass %) Fluid 1 | Fluid 2 | Fluid 3 | Fluid A | Traction Coefficient | Low Temperature Viscosity (Brookfield Method) −30° C. mPa.s |
|---|---|---|---|---|---|---|
| Fluid 4 | 30 | — | — | 70 | 0.094 | 12000 |
| Fluid 5 | — | 33 | — | 67 | 0.093 | 12000 |
| Fluid 6 | — | — | 38 | 62 | 0.092 | 12000 |

As apparent from the results in Table 2, Fluids 1, 2, and 3 according to the present invention can be significantly improved in low-temperature viscosity properties with the traction coefficient almost unchanged by being mixed with Fluid A, i.e., 2-methyl-2,4-dicyclohexylpentane which is an existing traction drive fluid.

EXAMPLES 7 to 19

Fluids 7 to 19 were prepared by blending Fluid 1 or 2 with various viscosity index improvers (B) selected from the group consisting of a polymethcrylate (PMA) having a number-average molecular weight of 18,000, a polyisobutylene (PIB) having a number-average molecular weight of 2,700, and an ethylene-α-olefin copolymerhydridehavinganumber-averagemolecularweightof 99,000. The kinematic viscosity at 100° C., low-temperature viscosity at −30° C., and traction coefficient of each of Fluids 1, and 7 to 19 were measured. The results were shown in Tables 3 and 4.

COMPARATIVE EXAMPLES 4 to 6

Similarly to Examples 7 to 19, Fluids B to D were prepared by blending Fluid A with various viscosity index improvers (B) selected from the group of PMA, PIB and OCP. The kinematic viscosity at 100° C., low-temperature viscosity at −30° C., and traction coefficient of each of Fluids B to D were measured. The results are shown in Tables 3 and 4.

TABLE 3

| | Composition (mass %) | | | | | Kinematic Viscosity | Low Temperature Viscosity (Brookfield method) | Traction Coefficient |
|---|---|---|---|---|---|---|---|---|
| | | | Component (B) | | | | | |
| | Fluid 1 | Fluid A | PMA | PIB | OCP | 100° C. $mm^2/s$ | −30° C. mPa · s | |
| Fluid 1 | 100 | — | — | — | — | 3.6 | 1900 | 0.081 |
| Fluid 7 | 95.8 | — | 4.2 | | — | 5.0 | 2800 | 0.078 |
| Fluid 8 | 96.2 | — | — | 3.8 | — | 5.0 | 4600 | 0.080 |
| Fluid 9 | 98.4 | — | — | — | 1.6 | 5.0 | 3000 | 0.080 |
| Fluid 10 | 28.7 | 67.1 | 4.2 | — | — | 5.0 | 18000 | 0.090 |
| Fluid 11 | 43.3 | 52.9 | — | 3.8 | — | 5.0 | 19000 | 0.090 |
| Fluid 12 | 31.5 | 66.8 | — | — | 1.6 | 5.0 | 18000 | 0.092 |
| Fluid B | — | 95.2 | 4.8 | — | — | 5.0 | 36000 | 0.094 |
| Fluid C | — | 95.7 | — | 4.3 | — | 5.0 | 59000 | 0.097 |
| Fluid D | — | 98.2 | — | — | 1.8 | 5.0 | 37000 | 0.097 |

TABLE 4

| | Composition (mass %) | | | | | Kinematic Viscosity | Low Temperature Viscosity (Brookfield method) | Traction Coefficient |
|---|---|---|---|---|---|---|---|---|
| | | | Component (B) | | | | | |
| | Fluid 2 | Fluid A | PMA | PIB | OCP | 100° C. $mm^2/s$ | −30° C. mPa · s | |
| Fluid 2 | 100 | — | — | — | — | 3.7 | 2400 | 0.081 |
| Fluid 13 | 96.1 | — | 3.9 | — | — | 5.0 | 3600 | 0.078 |
| Fluid 14 | 96.5 | — | — | 3.5 | — | 5.0 | 5800 | 0.080 |
| Fluid 15 | 98.5 | — | — | — | 1.5 | 5.0 | 3800 | 0.080 |
| Fluid 16 | 31.6 | 64.2 | 4.2 | — | — | 5.0 | 18000 | 0.089 |
| Fluid 18 | 48.1 | 48.1 | — | 3.8 | — | 5.0 | 18000 | 0.089 |
| Fluid 19 | 35.4 | 63.0 | — | — | 1.6 | 5.0 | 18000 | 0.091 |
| Fluid B | — | 95.2 | 4.8 | — | — | 5.0 | 36000 | 0.094 |
| Fluid C | — | 95.7 | — | 4.3 | — | 5.0 | 59000 | 0.097 |
| Fluid D | — | 98.2 | — | — | 1.8 | 5.0 | 37000 | 0.097 |

As apparent from the results shown in Tables 3 and 4, the high-temperature kinematic viscosity of the fluids can be significantly increased without changing the traction coefficient and low temperature viscosity properties, by being blended with (B) viscosity index improvers.

EXAMPLES 20 to 37

Fluid 20 to 34 were prepared by blending Fluid 1 or 2 with Fluid A, (B) viscosity index improver, (C) ashless dispersant, and (D) phosphorus additive in accordance with the formulations shown in Tables 5 to 7. The anti-wear properties and oxidation stability of each of the fluids were evaluated. The results are also shown in Tables 5 to 7.

Anti-wear properties were evaluated by Shell four ball test conducted under the conditions of 80° C., 1,800 rpm, 294 N (30 kgf) for 60 minutes in accordance with ASTM D 2266 so as to measure the size of the scar caused by wear on the steel ball. The oxidation stability was evaluated by conducting an oxidation test under the conditions of 150° C. and 96 hours in accordance with JIS K 2514 "Lubricating Oil-Determination of oxidation stability".

TABLE 5

| Composition (mass %) | | Fluid 20 | Fluid 21 | Fluid 22 | Fluid 23 | Fluid 24 | Fluid 25 | Fluid 26 |
|---|---|---|---|---|---|---|---|---|
| Base Oil | Fluid 1 | 97.35 | 97.35 | 95.25 | 92.65 | 99.5 | 97.0 | 99.35 |
| Component B | OCP | — | — | 1.6 | — | — | — | — |
| | PMA | — | — | — | 4.2 | — | — | — |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorous Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.45 | 0.47 | — | 1.56 | 0.43 |
| Oxidation Stability Test | | | | | | | | |
| Total Acid Value Increase, mgKOH/g | | 0.51 | 0.53 | 0.49 | 0.51 | 0.47 | — | 1.74 |
| Lacquer Rating (deposit) | | none | none | none | none | medium | — | dark |
| n-pentane insoluble, mass % | | 0.00 | 0.00 | 0.00 | 0.00 | 0.22 | — | 0.81 |

TABLE 6

| Composition (mass %) | | Fluid 27 | Fluid 28 | Fluid 29 | Fluid 30 | Fluid 31 | Fluid 32 | Fluid 33 |
|---|---|---|---|---|---|---|---|---|
| Base Oil | Fluid 2 | 97.35 | 97.35 | 95.25 | 92.65 | 99.5 | 97.0 | 99.35 |
| Component B | OCP | — | — | 1.6 | — | — | — | — |
| | PMA | — | — | — | 4.2 | — | — | — |
| Component C | Ashless Dispersant A | 1.5 | — | 1.5 | 1.5 | — | 1.5 | — |
| | Ashless Dispersant B | 1.0 | 2.5 | 1.0 | 1.0 | — | 1.0 | — |
| Component D | Phosphorous Additive A | 0.15 | 0.15 | 0.15 | 0.15 | — | — | 0.15 |
| Other | Oxidation Inhibitor A | — | — | 0.5 | 0.5 | 0.5 | 0.5 | 0.5 |
| Shell Four Ball Test Wear-scar Size, mm | | — | — | 0.53 | 0.49 | — | 1.43 | 0.52 |
| Oxidation Stability Test | | | | | | | | |
| Total Acid Value Increase, mgKOH/g | | 0.50 | 0.51 | 0.55 | 0.55 | 0.72 | — | 1.48 |
| Lacquer Rating (deposit) | | none | none | none | none | medium | — | dark |
| n-pentane insoluble, mass % | | 0.00 | 0.00 | 0.00 | 0.00 | 0.31 | — | 1.01 |

TABLE 7

| Composition (mass %) | | Fluid 34 | Fluid 35 | Fluid 36 | Fluid 37 |
|---|---|---|---|---|---|
| Base Oil | Fluid 1 | 30.48 | 27.80 | — | — |
| | Fluid 2 | — | — | 34.27 | 30.56 |
| | Fluid A | 64.77 | 64.85 | 60.98 | 62.09 |
| Component B | OCP | 1.6 | — | 1.6 | — |
| | PMA | — | 4.2 | — | 4.2 |
| Component C | Ashless Dispersant A | 1.5 | 1.5 | 1.5 | 1.5 |
| | Ashless Dispersant B | 1.0 | 1.0 | 1.0 | 1.0 |
| Component D | Phosphorous Additive A | 0.15 | 0.15 | 0.15 | 0.15 |
| Other | Oxidation Inhibitor A | 0.5 | 0.5 | 0.5 | 0.5 |
| Shell Four Ball Test | | | | | |
| Wear-scar Diameter, mm | | 0.52 | 0.51 | 0.48 | 0.51 |
| Oxidation Stability Test | | | | | |
| Total Acid Value Increase, mgKOH/g | | 0.58 | 0.55 | 0.56 | 0.57 |
| Lacquer Rating (deposit) | | none | none | none | none |
| n-pentane insoluble, mass % | | 0.00 | 0.00 | 0.00 | 0.00 |

The terms in Tables 5 to 7 denote the following compounds:

(1) OCP: same as the one shown in Table 3

(2) PMA: same as the one shown in Table 3

(3) Ashless dispersant A: alkenylsuccinimide (bis-type, number average molecular weight 5,500)

(4) Ashless dispersant B: borated alkenylsuccinimide (mono-type, number average molecular weight 4,500)

(5) Phosphorus-containing additive A: dipehnylhydrogene-phosphite (6) Oxidation Inhibitor A: bisphenol- based As apparent from the results shown in Tables 5 to 7, blend of (C) ashless dispersant and (D) phosphorus additive in combination can provide a traction drive fluid with oxidation stability and detergency.

EXAMPLES 38 to 53

Fluids 38 to 53 were prepared by blending Fluid 1 or 2 with Fluid A, and additives such as (B) a viscosity index improver, (C) an ashless dispersants (D) a phosphorus additive, (E) a friction modifier, (F) a metallic detergent in accordance with the formulations shown in Tables 8 to 10. The dependence of friction coefficient on slipping speed of each Fluids 38 to 53 and Fluids 20 and 27 was measured using a low velocity slip testing machine under the following conditions. The dependence of friction coefficient on slipping speed was expressed by the value of ($\mu$(1 rpm) /$\mu$ (50 rpm). If the value exceeds 1, the dependence was graded as positive gradient. If the value is less than 1, the dependence was graded as negative gradient.

[Low Velocity Slipping Test]

(1) Test conditions: JASO M349-95 "Automatic transmission fluid-determination of shudder inhibition capability"

(2) Oil amount: 0.2 L (3) Oil temperature: 80° C., (4) Surface pressure: 0.98 Mpa

TABLE 8

| Composition (mass %) | | Fluid 38 | Fluid 39 | Fluid 40 | Fluid 41 | Fluid 42 | Fluid 43 | Fluid 1 | Fluid 20 |
|---|---|---|---|---|---|---|---|---|---|
| Base oil | Fluid 1 | 99.85 | 99.85 | 99.5 | 99.5 | 94.6 | 92.0 | 100 | 97.35 |
| Component B | OCP | — | — | — | — | 1.6 | — | — | — |
| | PMA | — | — | — | — | — | 4.2 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |
| Component D | Phosphorous Additive A | — | — | — | — | 0.15 | 0.15 | — | 0.15 |
| Component E | Friction Modifier A | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate A | — | — | — | 0.5 | 0.5 | 0.5 | — | — |

TABLE 8-continued

| Composition (mass %) | | Fluid 38 | Fluid 39 | Fluid 40 | Fluid 41 | Fluid 42 | Fluid 43 | Fluid 1 | Fluid 20 |
|---|---|---|---|---|---|---|---|---|---|
| Other | Oxidation Inhibitor A | — | — | — | — | 0.5 | 0.5 | — | — |
| Low Velocity Slippage Test $\mu$ (1 rpm)/$\mu$ (50 rpm) | | 0.80 Positive Gradient | 0.85 Positive Gradient | 0.88 Positive Gradient | 0.90 Positive Gradient | 0.88 Positive Gradient | 0.87 Positive Gradient | 1.53 Negative Gradient | 1.34 Negative Gradient |

TABLE 9

| Composition (mass %) | | Fluid 44 | Fluid 45 | Fluid 46 | Fluid 47 | Fluid 48 | Fluid 49 | Fluid 2 | Fluid 27 |
|---|---|---|---|---|---|---|---|---|---|
| Base oil | Fluid 2 | 99.85 | 99.85 | 99.5 | 99.5 | 94.6 | 92.0 | 100 | 97.35 |
| Component B | OCP | — | — | — | — | 1.6 | — | — | — |
| | PMA | — | — | — | — | — | 4.2 | — | — |
| Component C | Ashless Dispersant A | — | — | — | — | 1.5 | 1.5 | — | 1.5 |
| | Ashless Dispersant B | — | — | — | — | 1.0 | 1.0 | — | 1.0 |
| Component D | Phosphorous Additive A | — | — | — | — | 0.15 | 0.15 | — | 0.15 |
| Component E | Friction Modifier A | 0.15 | — | — | — | 0.15 | 0.15 | — | — |
| | Friction Modifier B | — | 0.15 | — | — | — | — | — | — |
| Component F | Mg Sulfonate A | — | — | 0.5 | — | — | — | — | — |
| | Ca Sulfonate A | — | — | — | 0.5 | 0.5 | 0.5 | — | — |
| Other | Oxidation Inhibitor A | — | — | — | — | 0.5 | 0.5 | — | — |
| Low Velocity Slippage Test $\mu$ (1 rpm)/$\mu$ (50 rpm) | | 0.85 Positive Gradient | 0.86 Positive Gradient | 0.90 Positive Gradient | 0.89 Positive Gradient | 0.89 Positive Gradient | 0.90 Positive Gradient | 1.48 Negative Gradient | 1.37 Negative Gradient |

TABLE 10

| Composition (mass %) | | Fluid 50 | Fluid 51 | Fluid 52 | Fluid 53 |
|---|---|---|---|---|---|
| Base Oil | Fluid 1 | 28.34 | 27.6 | — | — |
| | Fluid 2 | — | — | 28.38 | 30.35 |
| | Fluid A | 66.26 | 64.4 | 66.22 | 61.65 |
| Component B | OCP | 1.6 | — | 1.6 | — |
| | PMA | — | 4.2 | — | — |
| Component C | Ashless Dispersant A | 1.5 | 1.5 | 1.5 | — |
| | Ashless Dispersant B | 1.0 | 1.0 | 1.0 | — |
| Component D | Phosphorous Additive A | 0.15 | 0.15 | 0.15 | — |
| Component E | Friction Modifier A | 0.15 | 0.15 | 0.15 | — |
| | Friction Modifier B | — | — | — | — |
| Component F | Mg Sulfonate A | — | — | — | — |
| | Ca Sulfonate A | 0.5 | 0.5 | 0.5 | 0.5 |
| Other | Oxidation Inhibitor A | 0.5 | 0.5 | 0.5 | — |
| Low Velocity Slippage Test $\mu$(1 rpm)/$\mu$(50 rpm) | | 0.90 Positive Gradient | 0.89 Positive Gradient | 0.91 Positive Gradient | 0.90 Positive Gradient |

The terms used in Tables 8 to 10 denote the following compounds:

(1) OCP: same as the one shown in Table 3

(2) PMA: same as the one shown in Table 3

(3) Ashless dispersant A: same as the one shown in Table 5

(4) Ashless dispersant B: same as the one shown in Table 5

(5) Phosphorus additive A: same as the one shown in Table 5

(6) Oxidation inhibitor A: same as the one shown in Table 5

(7) Friction modifier A: ethoxylated oleylamine (8) Friction modifier B: oleylamine (9) Mg sulfonate A: petroleum-based, total base number (perchloric acid titration method): 300 mgKOH/g Mg content: 6.9 percent by mass

(10) Ca sulfonate A: petroleum-based, total base number (perchloric acid titration method): 300 mgKOH/g Ca content: 12.0 percent by mass As apparent from the results shown in Tables 8 to 10, blend of (E) a friction modifier and/or (F) a metallic detergent can provide a traction drive fluid with friction properties which are optimized for a wet clutch such as a clutch for the gear shift and a slip-lock-up clutch.

What is claimed is:

1. A traction drive fluid which comprises a saturated polycyclic hydrocarbon compound obtained by hydrogenating a trimeric compound of a cyclopentadiene-based condensed hydrocarbon compound resulting from the Diels-Alder reaction of cyclopentadiene and then isomerizing the resulting compound so as to have a pour point of −10° C. or below.

2. The traction drive fluid according to claim 1 which further comprises at least one member selected from the group consisting of (A) a mineral oil and a synthetic oil having a molecular weight of 150 to 800.

3. The traction drive fluid according to claim 1 which further comprises (B) a viscosity index improver.

4. The traction drive fluid according to claim 3 wherein said viscosity index improver is an ethylene-α-olefin copolymer having a number-average molecular weight of 800 or more but 150,000 or less, and the hydrides thereof.

5. The traction drive fluid according to claim 1, which further comprises (C) an ashless dispersant and (D) a phosphorus additive.

6. The traction drive fluid according to claim 1, which further comprises (E) a friction modifier which has an alkyl or alkenyl group having 6 to 30 carbon atoms but no hydrocarbon group having 31 or more carbon atoms, per molecule.

7. The traction drive fluid according to claim 1, which further comprises (F) a metallic detergent having a tal base number of 20 to 450 mgKOH/g.

* * * * *